US005083009A

United States Patent [19]

Reiser et al.

[11] Patent Number: 5,083,009

[45] Date of Patent: Jan. 21, 1992

[54] FOG-RESISTANT MIRROR ASSEMBLY

[76] Inventors: Carl Reiser, 142 Cider Mill Rd., Glastonbury, Conn. 06033; Richard Sawyer, 5 Trails End Dr., Canton, Conn. 06019

[21] Appl. No.: 367,140

[22] Filed: Jun. 16, 1989

[51] Int. Cl.[5] ..... H05B 3/84

[52] U.S. Cl. ..... 219/219; 219/543

[58] Field of Search ..... 219/219, 213, 345, 522, 219/543, 528, 529, 549, 501

[56] References Cited

U.S. PATENT DOCUMENTS

| | | | |
|---|---|---|---|
| 2,837,622 | 6/1958 | Tuttle | 219/448 |
| 3,366,777 | 1/1968 | Brittan | 219/522 |
| 3,555,239 | 1/1971 | Kerth | 219/125.1 |
| 3,781,524 | 12/1973 | Levin | 219/543 |
| 3,790,748 | 2/1974 | Vanlaethem | 219/219 |
| 3,887,788 | 6/1975 | Seibel | 219/219 |
| 4,144,992 | 3/1979 | Omae et al. | 219/125.11 |
| 4,145,593 | 3/1979 | Merrick et al. | 219/125.11 |
| 4,251,316 | 2/1981 | Smallbone | 219/219 |
| 4,559,430 | 12/1985 | Hayakawa | 219/125.11 |
| 4,641,013 | 2/1987 | Dunnigan | 219/501 |
| 4,644,139 | 2/1987 | Harrison | 219/543 |
| 4,665,304 | 5/1987 | Spencer | 219/219 |
| 4,731,519 | 3/1988 | Dieterle | 219/501 |

FOREIGN PATENT DOCUMENTS 1189667 3/1965 Fed. Rep. of Germany ..... 219/219

*Primary Examiner*—Teresa J. Walberg

*Attorney, Agent, or Firm*—William W. Jones

[57] ABSTRACT

The mirror assembly uses a reflective coating as a heating element for preventing fog formation on a mirror exposed to a humid environment such as is found in a bathroom. As compared to other typically reflective mirror coatings, the coating used in this invention has a relatively high resistance. The coating may be split into separate conductive elements with one or more scribe lines in order to control the length of the conductive path from inlet bus to outlet bus. The buses are made from an ultra thin foil tape which can be adhered to the reflective coating and which is solderable for securement of power lines thereto. The bus tape possesses both in plane and through plane conductive characteristics and can simply be cut to any length desired for the mirror sizes being produced. Power levels supplied to the mirror assembly are varied, with the initial level being higher so as to heat up the mirror quickly, and the maintenance level, which follows, being lower whereby mirror temperature can be maintained without producing an undesirable high mirror temperature. Power change is accomplished by a simple switch. If needed, the mirror assembly can possess a high degree of reflectivity.

6 Claims, 2 Drawing Sheets

FOG-RESISTANT MIRROR ASSEMBLY

This invention relates to prevention of fog formation, or quick removal thereof, from a bathroom mirror. The invention includes both a heater and control system designed to quickly heat a cool mirror to a temperature high enough to remove any existing fog and prevent further condensation, while not allowing the mirror surface temperature to become uncomfortably warm to the touch (about 130 degrees to 140 degrees F.).

The concept of electrically heating a mirror to prevent fog formation has been disclosed as early as U.S. Pat. No. 1,933,173. Many different heating element designs have been disclosed in the prior art since then. U.S. Pat. No. 4,665,304 contains summary of attempts in the prior art to prevent fogging of mirrors. In addition, the patent accurately describes the criteria for commercial success and makes the observation that the prior art has not met all the criteria elements; consequently, commercialization has not been widely achieved. The U.S. Pat. No. 4,665,304 structure meets these operational criteria, however it requires the development of a unique heating element to operate properly, and thus its commercial feasibility is questionable.

Dual power level systems for defogging mirrors are disclosed in U.S. Pat. Nos. 3,887,788 and in 3,160,736. The former patent uses a temperature sensor to switch from a low power resistive circuit to a high power resistive circuit, and the latter patent uses an interchange of two sliding glass mirrors in a medicine cabinet to affect the switch. In both cases however, the power supply is a constant voltage and the power levels are achieved by having two different resistive circuits as the heating element.

The present invention makes use of the reflective surface of the commercially available mirrors as the heating element. One advantage is low manufacturing cost since the mirrors are currently being mass produced. Another advantage resides in achievement of rapid heating time since the element is in intimate contact with the glass and it is substantially continuous over the surface of the mirror. The concept described herein uses one switching means obtaining two power levels by switching from the full line voltage (120 V) to a reduced voltage level, thereby giving effective full and half power levels.

The concept described herein uses currently available mass produced materials and meets all the operational criteria put forward in U.S. Pat. No. 4,665,304. Those operational criteria are that it must utilize conventional widely available mirror glass; must be compatible with conventional mirror installation techniques; must be capable of complying with applicable electrical safety codes; and must be capable of being manufactured economically for application to any of a very wide range of mirror sizes.

As previously noted the control system described herein employs two power levels; a low power and a high power. The heating element may be wired to the bathroom lighting system so as to be actuated by the lighting switch. When the light switch is turned on, the high power level will heat the mirror quickly so that in the event the shower is started soon after the light switch is turned on, the mirror temperature will stay higher than the rising room temperature caused by the onset of the shower. The lower power level is activated at a preset interval after the high power was started in order to prevent overheating the mirror.

A typical scenario for fog formation on a bathroom mirror is one where the room temperature is maintained at 68 degrees F. by the residence heating or air conditioning system. A person enters the bathroom, closes the door, enters the shower, and turns on the water, regulated to a typical temperature of 120 to 130 degrees F., and that person typically stays in the shower for five to ten minutes. This may raise the temperature in a small bathroom to 90 degrees F., at approximately 100% relative humidity, resulting in condensation on all surfaces below this temperature.

In order for the mirror in this environment to be free of fog at the end of the shower it is necessary to warm the mirror from its initial 68 degrees F. to about 90 degrees F. within a 7.5 minute period (average shower time) as an average design condition. Also, since it takes considerably more energy to remove condensation than to prevent it from forming, it is desirable to maintain the mirror temperature slightly above the room temperature during the first few minutes after the shower starts. Thus the design requirements for the mirror and control system are:

1. raise the mirror temperature to 90 degrees F. in 7.5 minutes; and
2. maintain the maximum steady state mirror temperature below 125 degrees F.

The power level required to raise the temperature of a mirror to 90 degrees F. (a 22 degree rise) in 7.5 minutes can be calculated from the properties of the mirror. A typical mirror in this application would be composed of one sheet of glass $\frac{1}{4}$ inch thick, or two sheets each $\frac{1}{8}$ inch thick. The reflective coating and heating elements contribute negligible mass to the assembly, but there may be a protective backing layer that could have significant mass. The backing layer may be ignored however if it is made from a poor heat conductor so as not to absorb a significant amount of heat during the warm up period.

Ordinary glass has a density of 2.3 to 2.6 grams/cc, and a specific heat of 0.16 to 0.2 btu/lb/degree F. The worst case combination of these variables is a mirror having a heat capacity of 0.7 btu/sq. ft/degree F. Thus, the heat input required to raise the temperature by three deg/minute is 120 btu/sq.ft/hour or 35 watts/sq.ft. Since the mirror temperature will closely parallel the room temperature during this time interval heat transfer to or from the room air is ignored in this calculation.

The power required to maintain a fog free condition after the initial start up period is considerably less than is needed to initially heat the mirror. The control system disclosed herein is based on a simple inexpensive method of reducing power by half by means of a switch which may be mechanical, electro-mechanical (as a relay), or electronic. The latter two would be controlled by a timing circuit in the simplest case, or alternatively, a differential temperature sensor could be used. We have discovered that 17.5 watts/sq.ft. is adequate to prevent fogging without producing excessive mirror temperatures. This is half the 35 watts/sq.ft. needed for the first 7.5 minutes.

A heat transfer calculation shows the power required to maintain the mirror temperature at the low power setting. During this period, room temperature is not ignored. Based on a desire to limit the mirror temperature to 125 degrees F., which is a comfortable touch temperature, the maximum working temperature differential ($\Delta$ T) is at least 35 degrees above the maximum room temperature. A typical natural convention heat transfer coefficient ($h_c$) with a temperature differential ($\Delta$ T) of 35 degrees F. is about 0.63 btu/sq.ft./hr, but combined radiation and convention ($h_c+h_r$) at room temperature is closer to 1.8 btu/sq.ft./hr. resulting in a steady state heat loss of:

$Q_{loss}=\Delta\ T\times(h_c+h_r)=35\times1.8=63$ btu/hr./sq.ft., which is equivalent to 18.4 watts/sq.ft.

At 17.5 watts/sq.ft. the temperature differential would be 33 degrees F. which would limit the touch temperature to 123 degrees F.

It is therefore an object of this invention to provide a heated mirror assembly for use in a bathroom operable to prevent fog formation on the mirror when the shower is used in the bathroom.

It is a further object of this invention to provide a heated mirror assembly of the character described wherein heat is provided to the mirror through the reflective coating thereon.

It is an additional object of this invention to provide a heated mirror assembly of the character described wherein heat is provided by flowing electrical current through the reflection coating in the mirror.

It is another object of this invention to provide a heated mirror of the character described wherein the current is passed through the reflective surface at a higher initial heat-up level, and a lower subsequent maintenance level.

It is another object of this invention to provide a mirror assembly of the character described which can provide high reflectivity in cases where such is required.

It is yet another object of this invention to provide a heated mirror of the character described wherein the lessening of current to the mirror is provided by means of an automatically actuated switch.

It is still another object of this invention to provide a mirror assembly of the character described which utilizes an ultra thin bus structure for connection of the heating element to a power source.

These and other objects and advantages of the invention will become more readily apparent from the following detailed description of a preferred embodiment thereof when taken in conjunction with the accompanying drawings in which.

Figure 1:
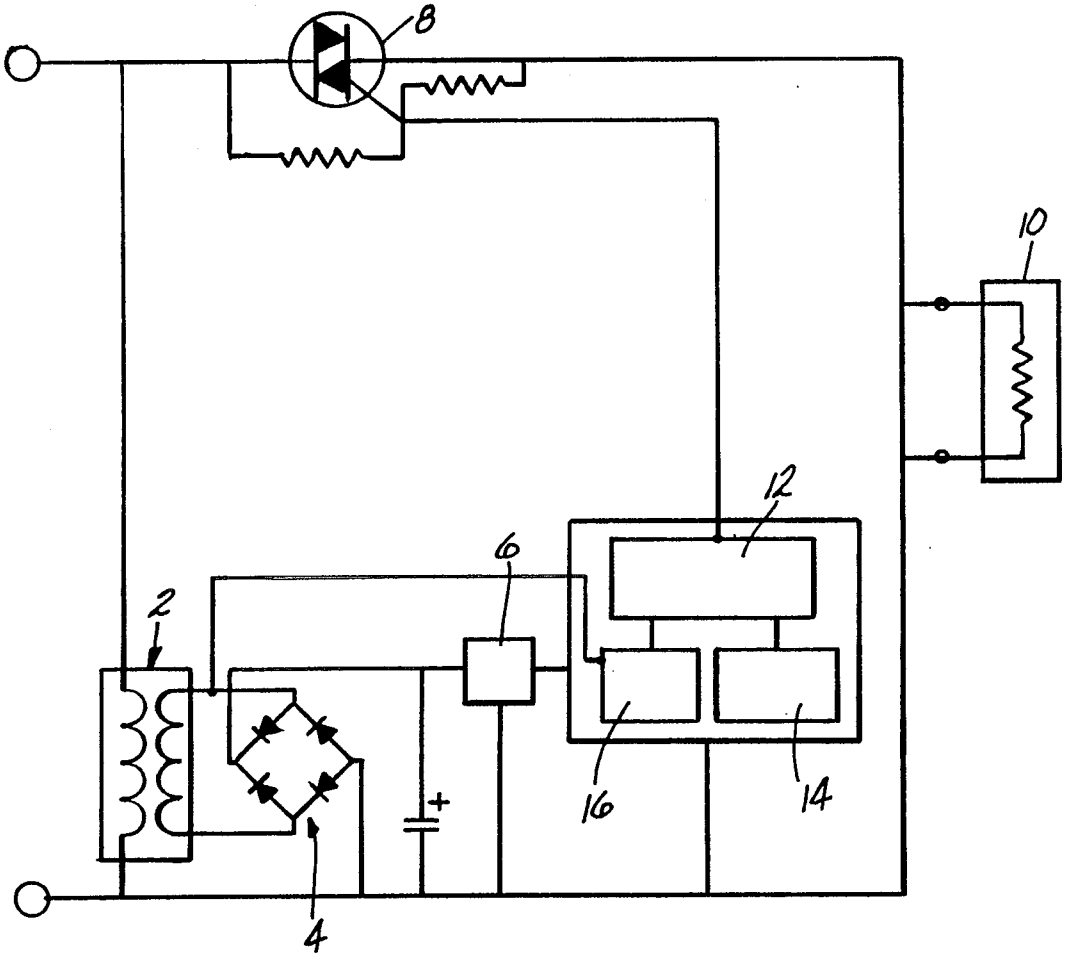
FIG. 1 is a schematic view of the timing and power control circuitry preferred for use with the invention.

Referring now to the drawings, there is shown in FIG. 1 a control system to accomplish the desired timing and power level changes using commercially available semi-conductor devices.

A step down transformer 2 providing a low AC voltage appropriate for the semiconductor devices is used in the control circuits. The AC voltage is rectified by rectifier 4 and regulated by regulator 6, typically to 5 V DC.

A Triac (bidirectional thyrister) switch 8 which is used to change the current fed to the mirror 10 from full power to half power. At full power the switch 8 is held "on" 100% of the time by applying a continuous current to the gate terminal thereof. For half power the switch 8 is turned "on" only on alternate half cycles of the AC line voltage. This action is controlled by the trigger 12.

A timer 14 contains a timing circuit that supplies an output voltage to the trigger 12 for 7.5 minutes. This holds the trigger 12, and consequently the switch 8 "on" full time until the timer 14 expires. The timer 14 will be reset each time the main power to the circuit is turned on.

For half power operation a zero crossing detection control element 16 senses the instant when the voltage in the line 9 is zero, thereupon going positive, and sending a signal to the trigger 12. The trigger 12 in turn applies a pulse to turn on the switch 8 at that time. This pulse is held for a half cycle to assure that the switch 8 stays "on" for that time duration.

Typical good quality household mirrors are one-quarter inch thick. Using a one-eighth inch thick mirror permits laminating an additional one-eighth inch thick material onto the back side of the mirror for electrical safety protection which permits meeting applicable safety codes. The resulting one-quarter inch thick mirror assembly closely resembles conventional mirrors in both size and weight and overall appearance. This fulfills the need for the mirror to be compatible with conventional mirror installation techniques. These techniques involve either mounting in decorative frames, onto medicine cabinets, or simply being attached to a flat wall.

The reflective coating of any given mirror type has a characteristic resistivity. To obtain the required wattage, the distance between the power buses must be determined as a function of the reflective coating on the mirror since the reflective coating is the heating element. For example, if an auto side-view type mirror reflective material, which uses chromium and/or nickel as the reflective material, is used, then the distance between power buses must be 3.4 feet. To use this type of material in a typical size medicine cabinet mirror which is 1.42 feet by 1.83 feet, the reflective-conducting surface must be divided into two equal parts and those parts must be joined electrically in series to obtain the desired distance. This is done by scribing a line down the center of the mirror in order to break the electrical continuity between the two adjacent parts. If the mirror is longer than 3.4 feet then there need not be a scribe line through the reflective surface/heating element. The reflective surface/heater material in order to be used in this invention must have a restivity of at least about 30 ohms per square. Lower restivity typically found in highly reflective materials such as silver will not be operative since the current path length between busses will be unduly long. Providing the necessary current path length in a typical bathroom mirror where the reflective-heater surface is made of silver or another high reflective material would require the use of an undesirably large number of scribe lines.

Figure 2:
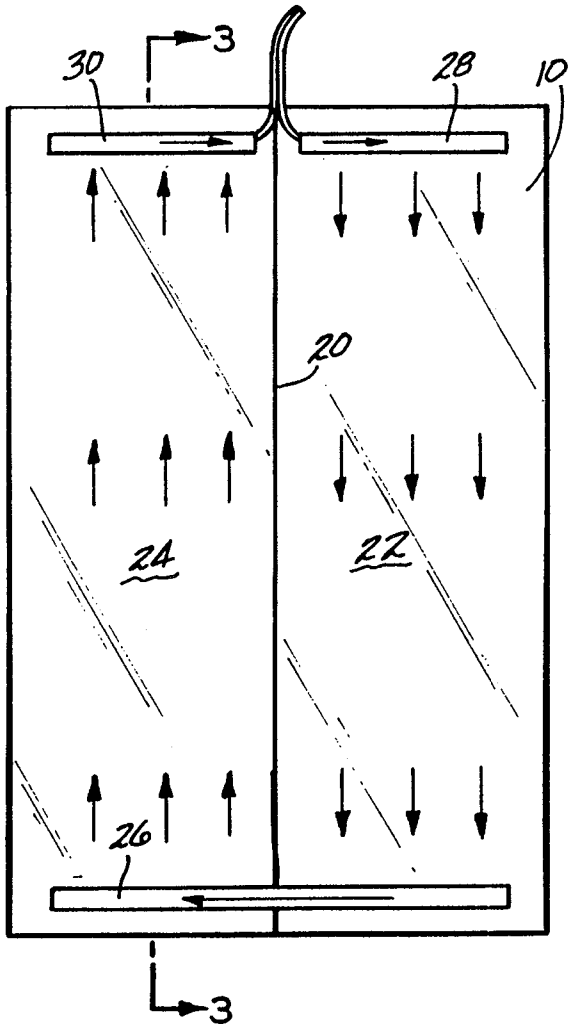
FIG. 2 is an elevational view of a mirror employing the use of the reflective surface as the conductor in accordance with this invention.

FIG. 2 depicts this size mirror and shows the scribe line 20 running vertically down the entire length of the mirror's reflective surface to bisect the latter into two adjacent segments 22 and 24. One end of the mirror 10 has a transfer bus 26 to transfer current from the right segment 22 to the left segment 24. The opposite end of the mirror 10 has two power buses 28 and 30. The bus 30 is connected to the neutral and the bus 28 is connected to the 120 volt line of a standard household electric supply circuit. This effectively makes the current path distance between the power buses 28 and 30 equal to twice the distance between the power buses 28, 30 and the transfer bus 26. As previously noted, when auto side view mirror material is used, the current path distance between the power bus 28 and the power bus 30 should be 3.4 feet which, when divided by two, equals 1.7 feet, which in turn is the distance between each power bus 28, 30 and the transfer bus 26. Since the mirror is 1.83 feet long, then the buses 26, 28, and 30 must be located approximately 1 inch in from each edge to obtain the 1.7 feet distance between the power buses 28, 30 and the transfer bus 26. This arrangement, when wired to a 120 volt power supply, provides the required 35 watts per square foot to heat the mirror.

Obtaining the proper wattage in this manner using scribe lines brings up the possibility of arching across the scribe lines if they are not wide enough. There are two possible consequences of this arcing if it occurs. The first is that the arc will be strong enough to cause local heating and fracture of the mirror. The second, and probably more likely, is that the coating will be burned away at the arc site, subsequently extinguishing the arc. This is likely, because the applied voltage is AC, so that the arc extinguishes every 1/120th second. Arcing is undesirable in either case, so the approach to be followed is preferably to provide a gap wide enough so that arcing across the scribe line 20 will not occur.

When the scribed metallized surface is open to air, the required air gap (scribe) width can be calculated as follows:

1. The dielectric strength of air is 75 volts/mil.
2. The peak voltage at 120 VAC is 170 volts.
3. The element must withstand at least 2X rated peak voltage.

This gives a minimum gap width of $170 \times 2/75 = 4.5$ mils.

In the preferred case, however, the scribe line 20 will be coated with a high dielectric strength epoxy or polyester which has a dielectric strength of 550 volts/mil which will prevent arcing with 1–2 mil width scribe lines. This will also desirably reduce the visability of the scribe lines.

Figure 3:
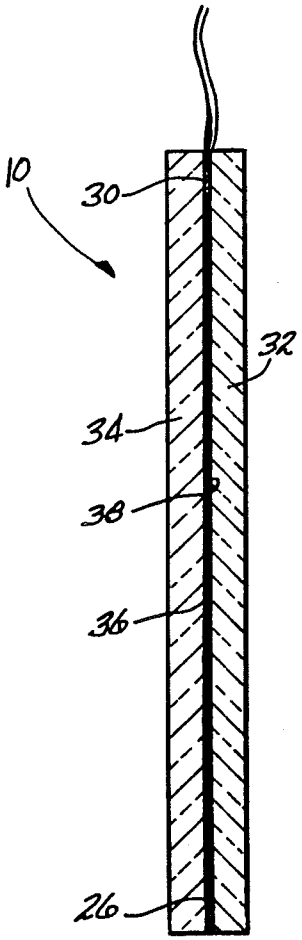
FIG. 3 is a cross-sectional view of the mirror of FIG. 3 taken along line 3—3 of FIG. 2.
Figure 4:
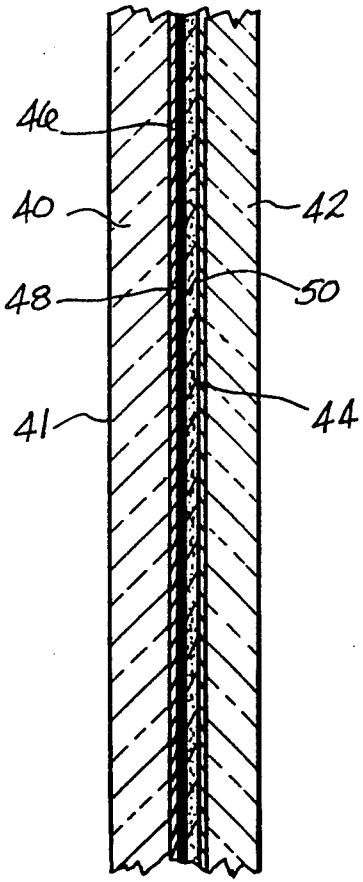
FIG. 4 is a cross-sectional view similar to FIG. 3 but showing an alternative embodiment of a heated mirror formed in accordance with this invention.

FIG. 3 shows a cross section of the assembly of FIG. 2. As previously noted, the mirror assembly 10 is formed from two ⅛ in. sheets to form a resultant ¼ in. thick composite. The one-eighth inch thick backing material sheet 32 shown could be any number of materials meeting electrical and fire codes suitable for the application, such as a commonly available fiberglass filled epoxy sheet. The backing sheet 32 is bonded to a front glass sheet 34 by a suitable adhesive material layer 36 which is not critical in composition. The bonding materials shown on FIG. 4 for this relatively low temperature benign environment application are plentiful. Many adhesives listed in the catalogues supplied by companies like Bostik Division of Emhart Corp. or Loctite Corp. would qualify. In the assembly 10 the reflective surface is indicated by the numeral 38 which is on the covered surface of the glass sheet 34.

An experiment was conducted in a small bathroom having a mirror outfitted with a heating element powered to these heating levels. The results correlated quite well with these calculations. A small bathroom was selected for this experiment since it represented a "worst case" siuation. It produces the most rapid room temperature rise since the volume of room air to be heated is small. In addition, the smallness of the room puts the mirror in close proximity to the shower head. The room volume was 150 cubic feet and the mirror was located within two feet of the shower head. The heating element was powered by the 120 volt houselhod lighting circuit through a manually operated switch which provided both full power and half power to the heating element depending upon the switch position. The switch controlled a diode rectifier which supplied either 35 watts per square foot of mirror surface or 17.5 watts per square foot of mirror surface.

The experiment was conducted as follows. The light switch was turned on with the switch in the high power position. Simultaneously the shower was turned on using 135 degree F. water. After 7.5 minutes the switch was put in the half power mode position. The shower was left on for an additional ten minutes. At no time during the experiment did the heated mirror fog. However, a similiar size unheated mirror located six feet from the shower head fogged within three minutes from the time the shower was started.

From the above example one can see that any size mirror with any resistivity can be supplied the proper wattage from either a 120 volt source or a 12 volt source when scribe lines on the mirror are acceptable.

In the event that the user finds scribe lines and/or the "soft" reflectivity mirrors esthetically objectionable, an adaptation of this invention is hereinafter described which overcomes these drawbacks.

U.S. Pat. No. 3,790,748 teaches the use of a dual glass laminate mirror assembly. One component of the laminate is a household quality reflective mirror. Laminated to the mirror component is a glass sheet coated on one surface with a conductive material serving as the heater. The proper wattage is obtained by varying the coating material type, quantity and location. Thus, there must be a different heating element for each mirror size, which is an undesirable limitation rendering mass production of the mirrors difficult.

This invention differs from the aforesaid concept in that the heater component herein will be the above described high resistivity ("soft" reflectivity) readily available mirrors, tailored to the different final mirror assembly sizes, by using scribe lines and adjusting the distance between buses as described previously. With this concept the reflective surface of the "heater" component is not used for reflectivity. It is located behind the high reflectivity mirror; consequently, the scribe lines will not show and the high reflectivity mirror will assure that the reflective quality is widely acceptable. A cross section of this embodiment is shown on FIG. 4. Two one-eighth inch thick mirrors 40 and 42 are bonded with an adhesive 44 after the appropriate buses and the scribe lines are installed. The highly reflective coating 46 of the reflective mirror 40 is covered by a scratch resistant paint layer 48 which faces the adhesive layer 44. The scribed reflective heating layer 50 on the rearward glass sheet 42 also faces the adhesive layer 44. The placement of the two ⅛ in. glass sheets on the outside and the conductive layer between them provides the electrical insulation required to meet safety codes. The high reflectivity mirrors are mass produced with a scratch resistant paint layer 48 which component serves as the dielectric preventing the scribed high resistivity conductor reflective layer 50 (the heater) from touching the low resistivity high reflective layer 46. In addition, further dielectric protection is provided by the adhesive layer 44. These two layers being very thin (approximately 5 mils) do not significantly restrict the heat from getting through to the outward facing glass surface 41 of the high reflectivity mirror 40. This is the surface on which fog will form; consequently, heat transfer to this location is very important.

As previously noted, the buses must extend over the entire width of the mirror at both ends, while lying between the two layers of the laminate. In the high reflective embodiment of this invention where the laminate is made up of a reflective mirror and a "heater" mirror, the bus thickness directly affects the heat transfer path length between the heater and the mirror which will directly affect the heating rate.

The degree of contact with the scribed heating reflective surface must be both uniform and intimate. If it is not uniform then the current flow between buses will be non-uniform and the heat input will be non-uniform, which may cause the mirror to crack due to thermal stress. At points where the buses and scribed reflection heating layer are not intimately coupled wattage produced at such points will be high, causing lower wattage over the mirror surface, resulting in an inability to remain fog free. In addition a local hot line will be created on the mirror where the buses are coupled with the mirror.

The bus structure utilized in the mirror assembly of this invention not only fulfills the operational requirements but is also low cost. The buss is formed from foil tapes developed by the 3M Company for use in EMI/RFI shielding for electronic equipment. Two of these tapes, 3M Nos. 1181 and 1345, have both through-plane and in-plane electrical conductive characteristics which are ideal for this application. In addition, they are rated for temperature in excess of 300 degrees F. (well above the requirement in this application) and are 3 to 4 mils thick. The standard width is ½ inch which provides adequate coupling area with the power source wires. The foil is copper or tinned copper, both of which are ideal for soldering purposes to the power source wires.

Application of the tape involves simply cutting it to desired length from the roll provided, stripping a backing layer from the tape and applying it to the mirror surface. When using the auto side-view mirror type materials for the heater, the mirror surface need only be cleaned in the area to be taped using isopropyl alcohol or a similar solvent to insure a good conductive surface. This mirror type is a "first surface" mirror which means that the reflective surface is on the surface of the glass facing the light to be reflected as opposed to the household type where the reflective surface is on the surface of the glass away from the direction of the light to be reflected. These household mirrors have a protective paint to prevent scratches since they use soft materials (silver and copper) for reflectivity. The first surface mirrors cannot be painted since this would hinder or eliminate their reflectivity. Consequently, they use hard materials (chrome and nickel alloys) to resist scratching. This is ideal for this invention since paint does not have to be removed prior to applying the tape buses.

Figure 5:
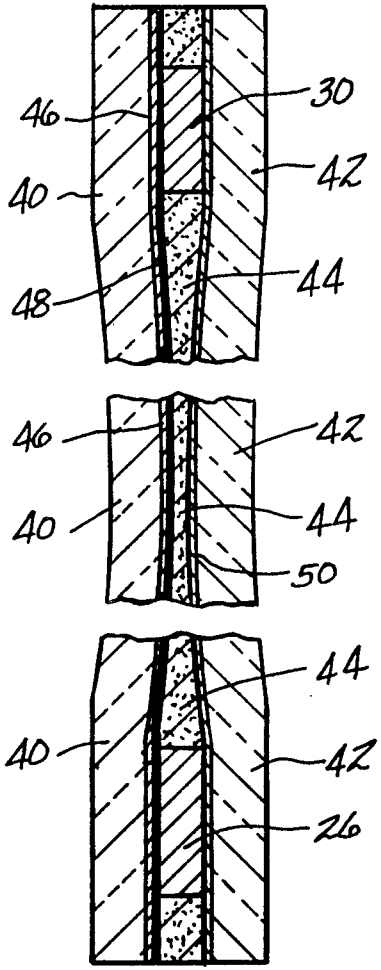
FIG. 5 is a cross-sectional view similar to FIGS. 3 and 4 but showing in exaggerated proportions, the manner in which continual pressure is exerted on the conductive tape at all times during continual thermal recycling of the mirror.

An important element to assure good contact through the many thermal cycles demanded by this application is a design feature that maintains a continual pressure on the tape at all times. This is accomplished by compressing the two glass components 40 and 42 together between the buses as shown in FIG. 5. This is a cross section of the laminate showing the two layers of glass 40 and 42 separated by the two buses 26 and 30. These buses 26 and 30 are 3 to 4 mils thick and will have a 1 to 2 mil polyester or other suitable dielectric film on top of the bus to assure the buses do not contact the high reflectivity surface 46 even though that surface already has a dielectric film in the form of the protective paint 48 used on these household mirrors. This results in a gap of approximately 5 mils. In order to maintain the constant pressure on the buses, the adhesive layer is set to be thinner than 5 mils (1 to 3 mils). When the two glass mirrors are brought together, pressure sufficient to bend the glass approximately 0.002 in. is applied to the glass surfaces between the buses, essentially bending the glass layers together before contacting the adhesive. Once the adhesive is contacted, the glass components 40 and 42 are held in a permanently bent position which maintains a constant pressure on the buses 26 and 30. It will be appreciated that in "soft" reflectivity applications, the glass sheet 42 can be replaced by a suitably stiff material which can be stressed like glass.

Since many changes and variations of the disclosed embodiments of the invention may be made without departing from the inventive concept, it is not intended to limit the invention otherwise than as required by the appended claims.

What is claimed is:

1. A fog resistant mirror assembly usable with conventional household current comprising:

a) a first glass sheet having an electrically conductive reflective material coating on a surface thereof;

b) a scribe line traversing said reflective material coating to divide the latter into adjacent electrically conductive separate parts, said scribe line being covered with a high dielectric strength material sufficient to prevent arcing across said scribe line;

c) a second glass sheet having a high reflective material coating thereon, said second sheet being adhered by an adhesive layer to said first glass sheet with said reflective material coating on said first glass sheet being disposed in close heat transfer relationship with said second glass sheet;

d) a current-inlet bus sandwiched between said first and second sheets and connected to one of said reflective material coating parts at one end of said first glass sheet;

e) a current outlet bus sandwiched between said first and second sheets and connected to an adjacent one of said reflective material coating parts at said one end of said first glass sheet;

f) a current transfer bus sandwiched between said first and second sheets and connected to both of said reflective material coating parts and spanning said scribe line at an opposite end of said first glass sheet; and g) said inlet, transfer and said outlet buses combining with said scribe line to increase the current flow path through said reflective material coating to a length which exceeds the distance between said first and opposite ends of said first glass sheet; and h) said buses having a through plane thickness which is greater than the thickness of said adhesive layer whereby said first and second glass sheets are stressed toward each other medially so as to apply a constant pressure on said buses to maintain intimate electrical contact between said reflective material coating and said buses.

2. A fog resistant mirror assembly usable with conventional household current comprising:

a) a first glass sheet having an electrically conductive reflective material coating on a surface thereof;

b) a scribe line traversing said reflective material coating to divide the latter into adjacent electrically conductive separate parts, said scribe line being covered with a high dielectric strength material sufficient to prevent arcing across said scribe line;

c) a backing sheet adhered by an adhesive layer to said reflective material coating to provide electrical and heat insulation to said assembly;

d) a current-inlet bus sandwiched between said sheets and connected to one of said reflective material coating parts at one end of said first glass sheet;

e) a current outlet bus sandwiched between said sheets and connected to an adjacent one of said reflective material coating parts at said one end of said first glass sheet;

f) a current transfer bus sandwiched between said sheets and connected to both of said reflective material coating parts and spanning said scribe line at an opposite end of said first glass sheet;

g) said inlet, transfer and said outlet buses combining with said scribe line to increase the current flow path through said reflective material coating to a length which exceeds the distance between said first and opposite ends of said first glass sheet; and h) said buses having a through plane thickness which is greater than the thickness of said adhesive layer whereby said first and second glass sheets are stressed toward each other medially so as to apply a constant pressure on said buses to maintain intimate electrical contact between said reflective material coating and said buses.

3. A fog-resistant mirror assembly comprising:

a) a first glass sheet having an electrically conductive reflective material coating on a surface thereof;

b) a current-inlet bus connected to said reflective material coating at an end of said first glass sheet;

c) a current outlet bus connected to said reflective material coating at an end of said first glass sheet;

d) said inlet and said outlet buses being formed from a foil tape which has both through plane and in plane electrical conductive characteristics, said foil portion of the tape being readily solderable for securement of power inlet and outlet lines thereto, said tape being adhesively secured to said conductive reflective material, and said tape being no thicker than about 5 mils; and e) a second sheet of electrical insulating material bonded to said first glass sheet by and adhesive layer which is thinner than said buses whereby said first and second sheets are stressed toward each other to apply a constant pressure on said buses.

4. The mirror assembly of claim 3 wherein said reflective material coating is divided into adjacent parts by a scribe line traversing said coating; said inlet and outlet buses being disposed at the same end of said glass sheet, one being disposed on each of said adjacent parts; means protecting said scribe line against arcing between said adjacent parts; and a current transfer bus electrically interconnecting said adjacent parts at an end of said glass sheet opposite said inlet and outlet buses.

5. The mirror assembly of claim 3 wherein said second sheet of electrical insulating material is a second sheet of glass having a high reflective material coating thereon to form the reflective surface of the mirror assembly; and a layer of electrical insulating material interposed between said high reflective material coating and said reflective material coating and buses.

6. The mirror assembly of claim 5 wherein said reflective material coating is divided into adjacent parts by a scribe line traversing said reflective material coating; and a current transfer bus electrically interconnecting said adjacent parts at an end of said first glass sheet opposite said inlet and outlet buses, said high reflective material coating hiding said buses and scribe line from sight.

* * * * *